US005836052A

United States Patent [19]

Chou

[11] Patent Number: 5,836,052

[45] Date of Patent: Nov. 17, 1998

[54] POSITIONING DEVICE FOR A RETRACTABLE HANDLE

[76] Inventor: Cheng-Tsan Chou, 27, Lane 280, Chung Zhen Road, Sa Lu, Taichung Shien, Taiwan

[21] Appl. No.: 723,786

[22] Filed: Sep. 30, 1996

[51] Int. Cl.[6] ..... A47B 95/02; B25G 1/04

[52] U.S. Cl. ..... 16/115; 190/115

[58] Field of Search ..... 16/115; 190/115, 190/18 A; 280/47.315, 47.371, 655, 655.1; 403/325

[56] References Cited

U.S. PATENT DOCUMENTS

| | | | |
|---|---|---|---|
| 5,367,743 | 11/1994 | Chang | 280/47.315 |
| 5,522,615 | 6/1996 | Kazmark, Jr. et al. | 280/655 |
| 5,628,088 | 5/1997 | Chen | 16/115 |
| 5,644,816 | 7/1997 | Chou | 16/115 |
| 5,692,266 | 12/1997 | Tsai | 16/115 |

FOREIGN PATENT DOCUMENTS

| | | | |
|---|---|---|---|
| 4-183672 | 6/1992 | Japan | 280/655 |
| 4-183673 | 6/1992 | Japan | 280/655 |

*Primary Examiner*—Chuck Y. Mah
*Assistant Examiner*—Donald M. Gurley
*Attorney, Agent, or Firm*—Peterson, Wicks, Nemer & Kamrath, P.A.

[57] ABSTRACT

A retractable handle comprises a first half grip, a second half grip coupled with the first half grip, a push button disposed beneath the first half grip and the second half grip, a base seat, first and second outer pipes disposed between the base seat and the first and second half grips, first and second inner pipes inserted in the corresponding first and second outer pipes respectively, a first positioning device disposed in a lower portion of the first inner pipe, a first rod inserted in the first inner pipe to connect the first portioning device and the push button, a second positioning device disposed in a lower portion of the second inner pipe, and a second rod inserted in the second inner pipe to connect the second positioning device and the push button.

20 Claims, 5 Drawing Sheets

POSITIONING DEVICE FOR A RETRACTABLE HANDLE

BACKGROUND OF THE INVENTION

The invention relates to a retractable handle in a suitcase. More particularly, the invention relates to a positioning device for a retractable handle.

A conventional handle is always protruded over a suitcase. The handle is easily broken or bent while the suitcase is consigned for shipment.

SUMMARY OF THE INVENTION

An object of the invention is to provide a positioning device which can position a retractable handle.

Accordingly, a retractable handle comprises a first half grip, a second half grip coupled with the first half grip, a push button disposed beneath the first half grip and the second half grip, a base seat, first and second outer pipes disposed between the base seat and the first and second half grips, first and second inner pipes inserted in the corresponding first and second outer pipes respectively, a first positioning device disposed in a lower portion of the first inner pipe, a first rod inserted in the first inner pipe to connect the first positioning device and the push button, a second positioning device disposed in a lower portion of the second inner pipe, a second rod inserted in the second inner pipe to connect the second positioning device and the push button, and first and second coiled springs disposed between the push button and the first and second half grips. First and second lateral plates extend from two opposite laterals of the push button. A first protrusion and a first round hole are formed on the first lateral plate. The first round hole receives an upper end of the first rod. A second protrusion and a second round hole are formed on the second lateral plate. The second round hole receives an upper end of the second rod. An upper seat has a first and second square holes to receive the corresponding first and second inner pipes respectively. The first inner pipe has a first aperture, a first positioning hole, a first notch, and a first retaining hole. The second inner pipe has a second aperture, a second positioning hole, a second notch, and a second retaining hole. A first lower seat encloses a lower portion of the first inner pipe. A second lower seat encloses a lower portion of the second inner pipe.

DETAILED DESCRIPTION OF THE INVENTION

Figure 1:
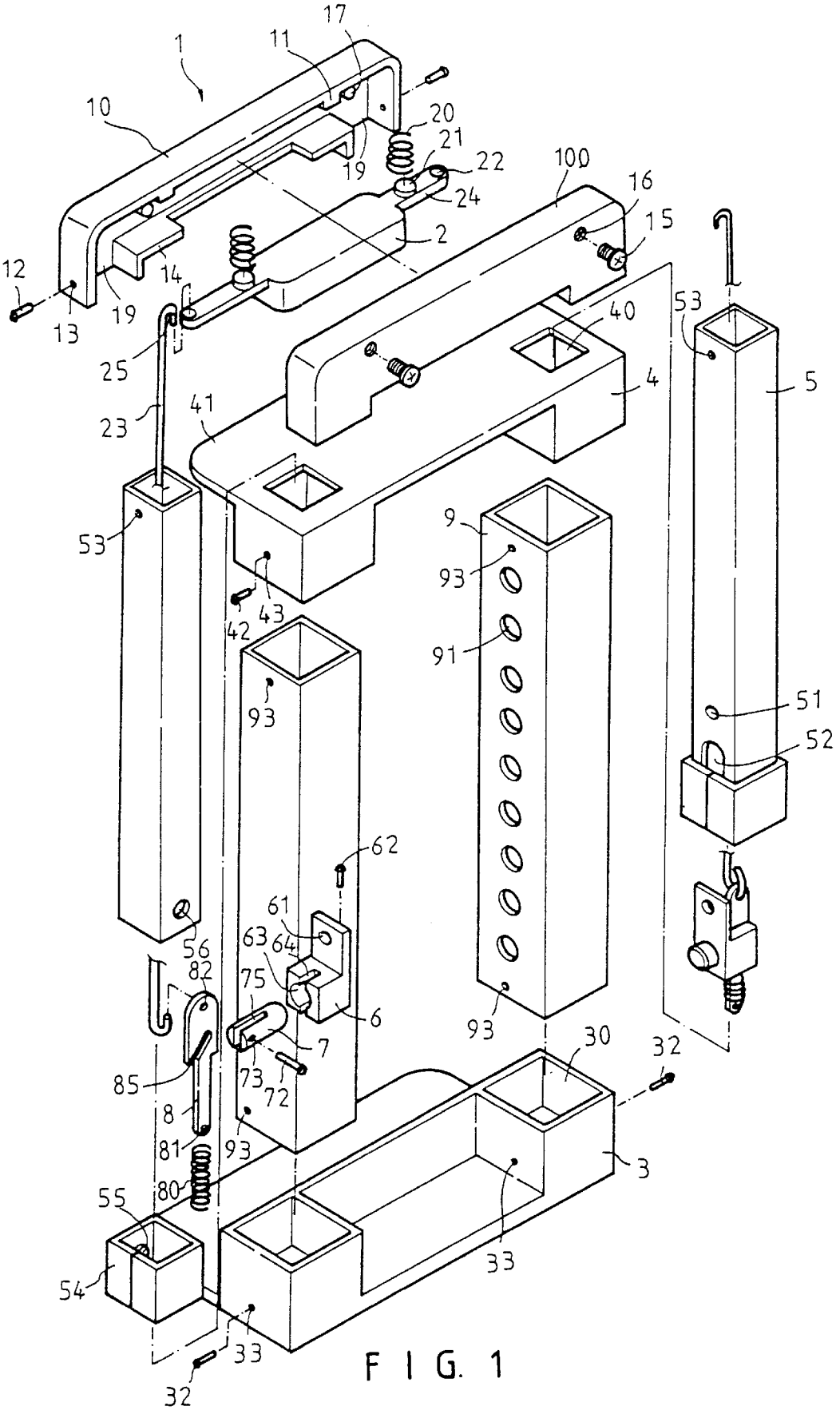
FIG. 1 is a perspective exploded view of a preferred embodiment in accordance with the invention.
Figure 2:
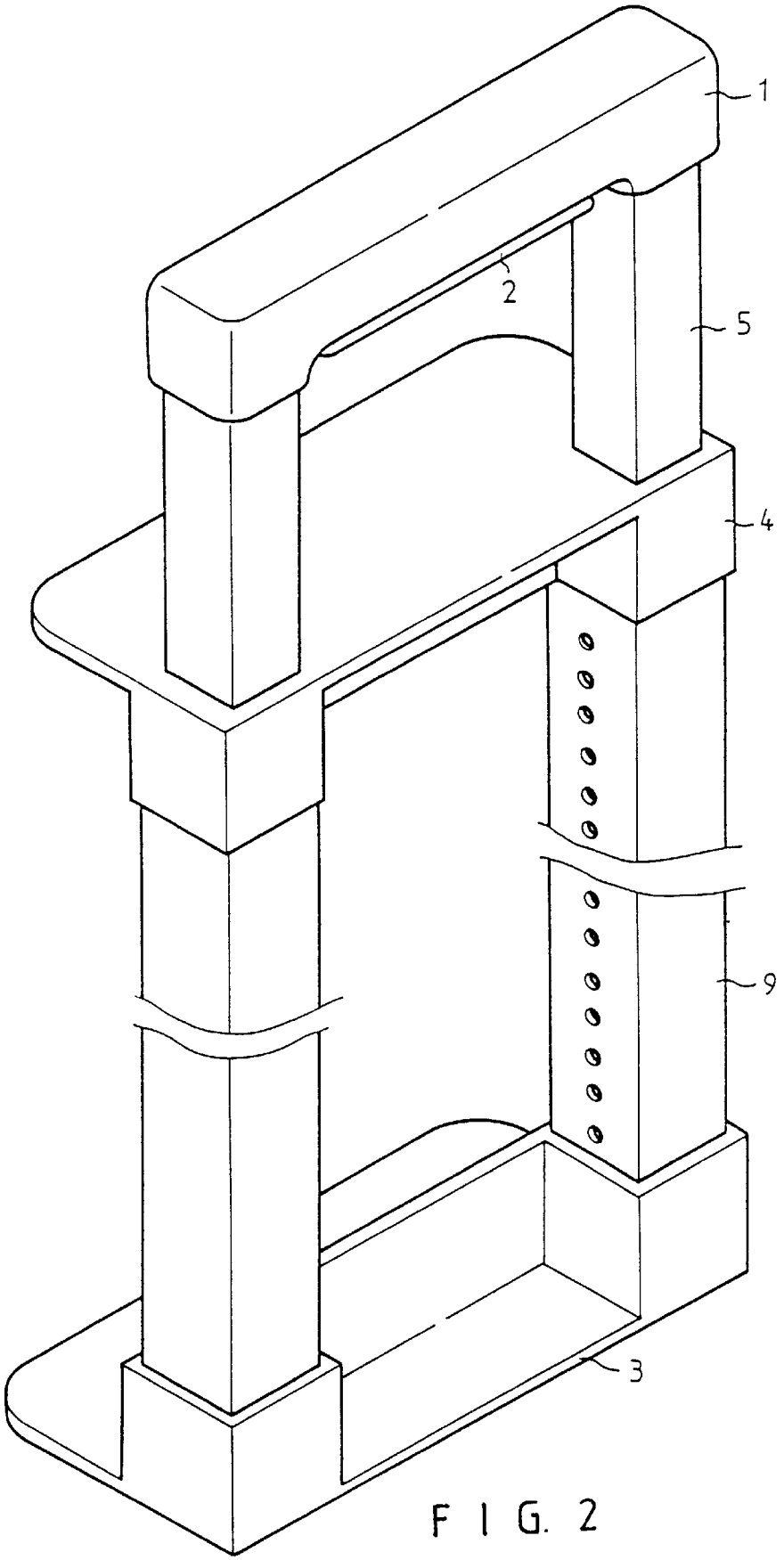
FIG. 2 is a perspective assembly view of FIG. 1.
Figures 3, 3A:
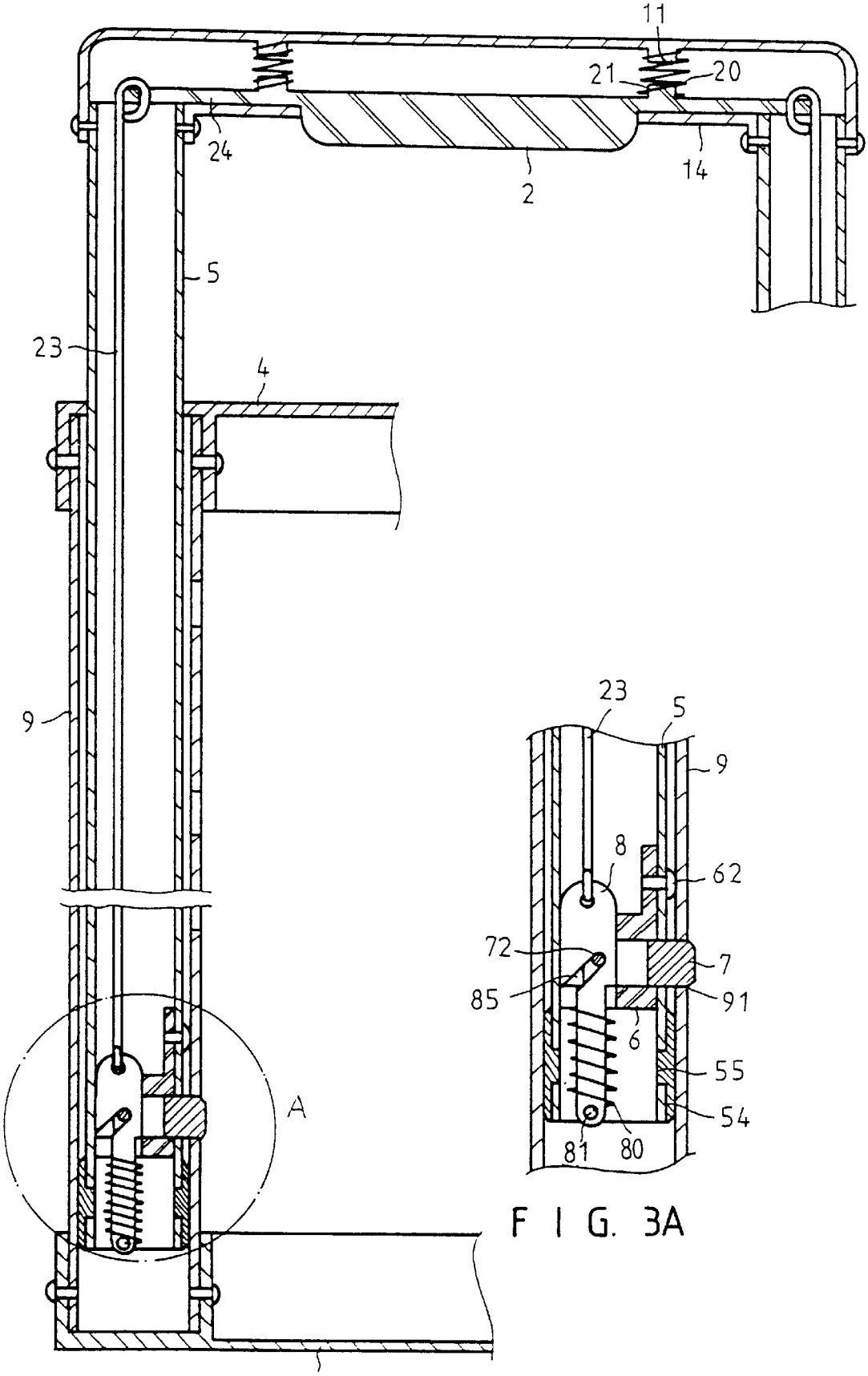
FIGS. 3 and 3A are partially sectional views illustrating a tenon inserted in a through hole of an outer pipe.
Figures 4, 4A:
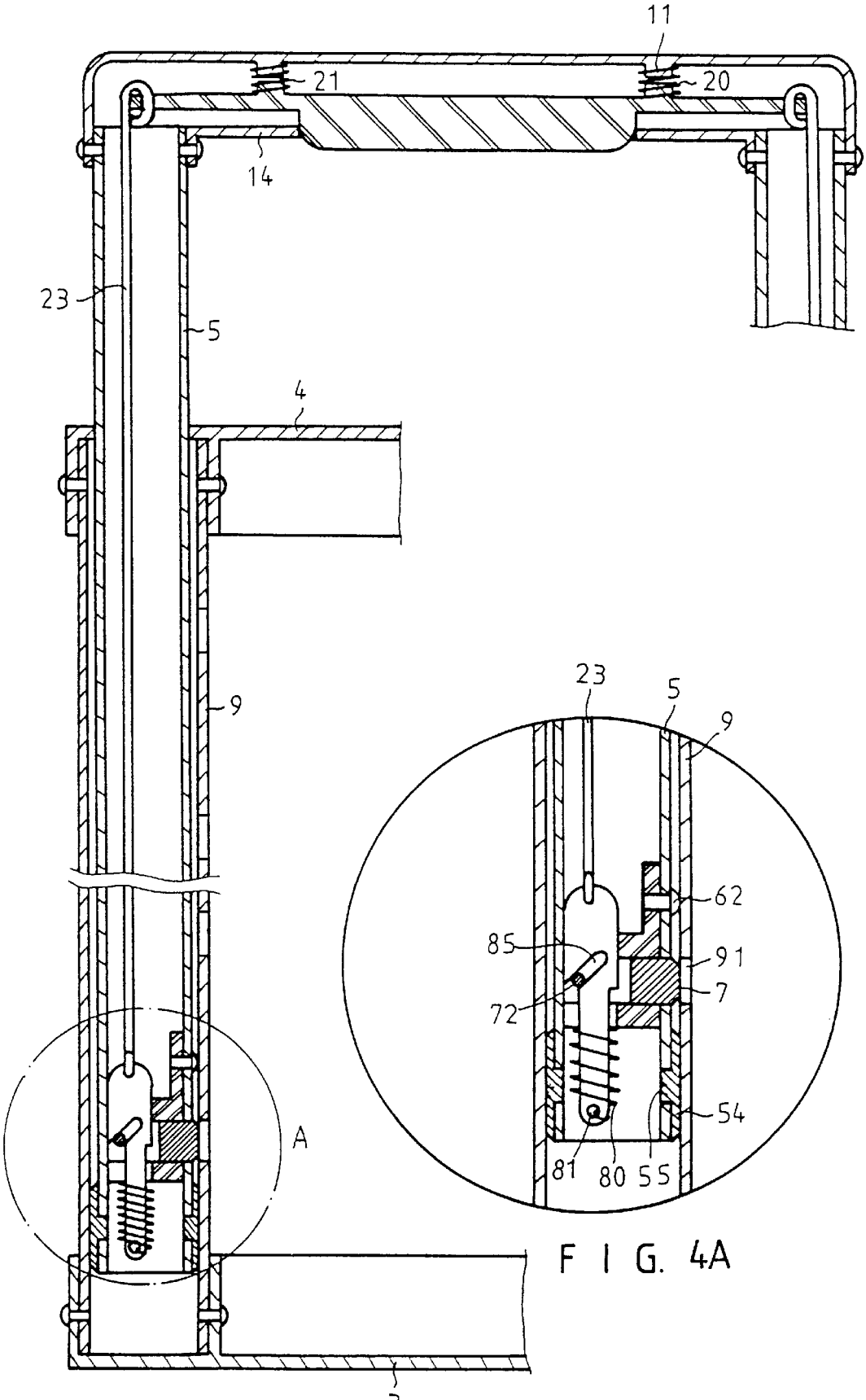
FIGS. 4 and 4A are partially sectional views illustrating a tenon disengaged from a through hole of an outer pipe.

Referring to FIGS. 1 to 4A, a retractable handle 1 comprises a first half grip 10, a second half grip 100 coupled with the first half grip 10, a push button 2 disposed beneath the first half grip 10 and the second half grip 100, a base seat 3, first and second outer pipes 9 disposed between the base seat 3 and the first and second half grips 10 and 100, a first and second inner pipes 5 inserted in the corresponding first and second outer pipes 9 respectively, a first positioning device disposed in a lower portion of the first inner pipe 5, a first rod 23 inserted in the first inner pipe 5 to connect the first positioning device and the push button 2, a second positioning device disposed in a lower portion of the second inner pipe 5, a second rod 23 inserted in the second inner pipe 5 to connect the second positioning device and the push button 2, and first and second coiled springs 20 disposed between the push button 2 and the first and second half grips 10 and 100. A first caging plate 14 is disposed in the first half grip 10. A first channel 19 is defined between the first caging plate 14 and the first half grip 10. A second caging plate 14 is disposed in the second half grip 100. A second channel 19 is defined between the second caging plate 14 and the second half grip 100. First and second lugs 11 are disposed in the first half grip 10. First and second posts 17 are disposed in the first half grip 10. A plurality of first screw holes 16 are formed on the first half grip 10. Third and fourth lugs 11 are disposed in the second half grip 100. Third and fourth posts 17 are disposed in the second half grip 100. A plurality of second screw holes 16 are formed on the second half grip 100. First and second lateral plates 24 extend from two opposite laterals of the push button 2. A first protrusion 21 and a first round hole 22 are formed on the first lateral plate 24. The first round hole 22 receives an upper end of the first rod 23. A second protrusion 21 and a second round hole 22 are formed on the second lateral plate 24. The second round hole 22 receives an upper end of the second rod 23. An upper seat 4 has first and second square holes 40 to receive the corresponding first and second inner pipes 5 respectively. The first inner pipe 5 has a first aperture 53, a first positioning hole 51, a first notch 52, and a first retaining hole 56. The second inner pipe 5 has a second aperture 53, a second positioning hole 51, a second notch 52, and a second retaining hole 56. A first lower seat 54 encloses a lower portion of the first inner pipe 5. A first protuberance 55 is disposed in the first lower seat 54. A second lower seat 54 encloses a lower portion of the second inner pipe 5. A second protuberance 55 is disposed in the second lower seat 54. The first positioning device has a first fixed seat 6, a first tenon 7 and a first slide plate 8. The first fixed seat 6 has a first positioning bore 61, a first inserted hole 63 to receive the first tenon 7, and a first groove 64 communicating with the first inserted hole 63. The first tenon 7 has a first transverse slot 75 and a first small hole 73. The first slide plate 8 has a first slant slot 85, a first circular hole 82 to receive a lower end of the first rod 23, and a first positioning aperture 81. A first compression spring 80 receives a lower portion of the first slide plate 8. The first slide plate 8 is inserted in the first transverse slot 75. A first pivot fastener 72 fastens the first tenon 7 and the first slide plate 8 via the first small hole 73 and the first slant slot 85. The second positioning device has a second fixed seat 6, a second tenon 7 and a second slide plate 8. The second fixed seat 6 has a second positioning pore 61, a second inserted hole 63 to receive the second tenon 7, and a second groove 64 communicating with the second inserted hole 63. The second tenon 7 has a second transverse slot 75 and a second small hole 73. The second slide plate 8 has a second slant slot 85, a second circular hole 82 to receive a lower end of the second rod 23, and a second positioning aperture 81. A second compression spring 80 receives a lower portion of the second slide plate 8. The second slide plate 8 is inserted in the second transverse slot 75. A second pivot fastener 72 fastens the second tenon 7 and the second slide plate 8 via the second small hole 73 and the second slant slot 85. The first outer pipe 9 has first and second vents 93 and a plurality of first through holes 91. The second outer pipe 9 has third and fourth vents 93 and a plurality of second through holes 91. The base seat 3 has first and second small apertures 33, a first recess hole 30 to receive a lower portion of the first outer pipe 9, and a second recess hole 30 to receive a lower portion of the second outer pipe 9.

A plurality of screws 15 fasten the first half grip 10 and the second half grip 100 via the corresponding first and second round holes 16. A pin 12 fastens the first inner pipe 5 and the first half grip 10 via the first hole 13 of the first half grip 10 and the first aperture 53. Another pin 12 fastens the second inner pipe 5 and the second half grip 10 via the second hole 13 of the second half grip 10 and the second aperture 53. A pin 42 fastens the first outer pipe 9 and the upper seat 4 via a first hole 43 of the upper seat 4 and the first upper vent 93 of the first outer pipe 9. Another pin 42 fastens the second outer pipe 9 and the upper seat 4 via a second hole 43 of the upper seat 4 and the second upper vent 93 of the second outer pipe 9. A pin 32 fastens the base seat 3 and the first outer pipe 9 via the first small hole 33 and the first lower vent 93 of the first outer pipe 9. Another pin 32 fastens the base seat 3 and the second outer pipe 9 via the second small hole 33 and the second lower vent 93 of the second outer pipe 9. A pin 62 fastens the first fixed seat 6 in the first inner pipe 5. Another pin 62 fastens the second fixed seat 6 in the second inner pipe 5.

The tenons 7 are always inserted in the corresponding through holes 91 respectively.

When the push button 2 is pushed upward, the first and second rods 23 will move upward. The tenons 7 will disengage from the corresponding through holes 91 respectively.

Figure 5:
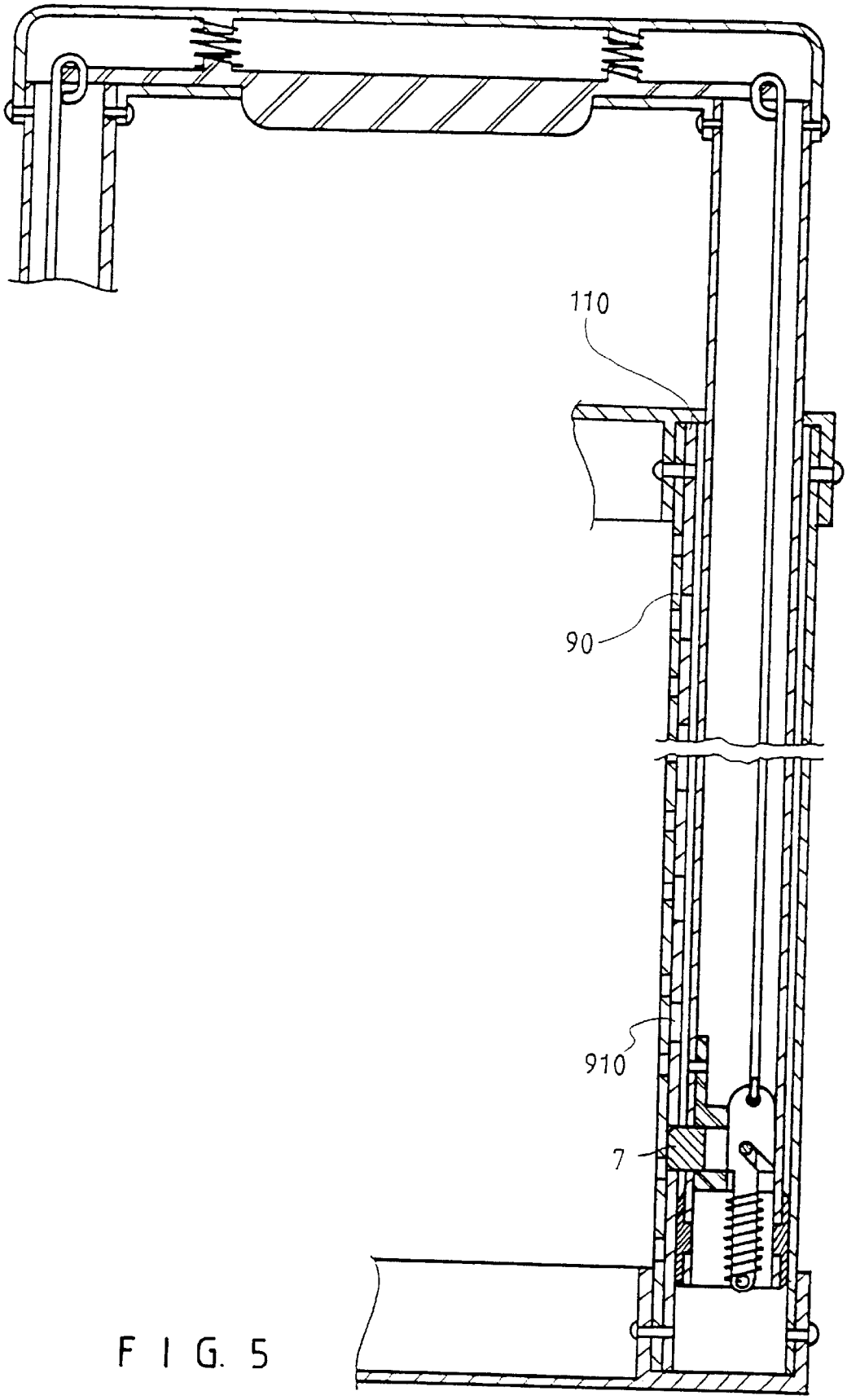
FIG. 5 is a partially sectional view of another preferred embodiment in accordance with the invention.

Referring to FIG. 5, a positioning plate 110 can be disposed between the first inner pipe 5 and the first outer pipe 90. Another positioning plate 110 can be disposed between the second inner pipe 5 and the second outer pipe 90. Each of the positioning plates 110 has a plurality of holes 910 for insertion of the respective tenons.

The invention is not limited to the above embodiment but various modification thereof may be made. It will be understood by those skilled in the art that various changes in form and detail may be made without departing from the scope of the invention.

I claim:

1. A retractable handle comprising, in combination: first and second outer pipes, with each of the outer pipes including a plurality of holes; first and second inner pipes inserted in the first and second outer pipes, respectively, with each of the first and second inner pipes including an upper portion and a lower portion; a grip fastened to the upper portions of each of the first and second inner pipes; a positioning device disposed in the power portion of each of the first and second inner pipes, with each positioning device comprising, in combination: a fixed seat disposed in the inner pipe, a tenon slideable in the fixed seat and insertable in one of the plurality of holes of the corresponding outer pipe, a slide plate slideable in the fixed seat, with the slide plate including a slant slot, and a pin extending from the tenon and into the slant slot for sliding the tenon in the fixed seat with movement of the slide plate; and means for sliding the slide plate in the fixed seat.

2. The retractable handle of claim 1 wherein the tenon includes a transverse slot with the slide plate being slideable in the transverse slot.

3. The retractable handle of claim 2 wherein the positioning device further comprises, in combination: a positioning aperture on the slide plate; and a compression spring received on the slide plate between the positioning aperture and the fixed seat.

4. The retractable handle of claim 3 wherein the sliding means comprises, in combination: a first rod inserted in the first inner pipe and connected to the slide plate of the positioning device disposed in the first inner pipe; a second rod inserted in the second inner pipe and connected to the slide plate of the positioning device disposed in the second inner pipe; and a push button disposed beneath the grip, with the first and second rods being connected to the push button.

5. The retractable handle of claim 4 further comprising, in combination: first and second lateral plates extending from the push button; a first round hole formed on the first lateral plate and for receiving an upper end of the first rod; and a second round hole formed on the second lateral plate and for receiving an upper end of the second rod.

6. The retractable handle of claim 5 further comprising, in combination: first and second coiled springs disposed between the push button and the grip.

7. the retractable handle of claim 6 further comprising, in combination: a first protrusion formed on the first lateral plate, with the first coiled spring being disposed on the first protrusion; and a second protrusion formed on the second lateral plate, with the second coiled spring being disposed on the second protrusion.

8. The retractable handle of claim 7 wherein the grip comprises, in combination: a first half grip; and a second half grip coupled with the first half grip.

9. the retractable handle of claim 8 wherein each of the first and second inner pipes include a notch extending from the lower portion for receipt of the tenon; and wherein each of the first and second inner pipes have a lower seat on the lower portion and for enclosing the notch.

10. The retractable handle of claim 9 wherein each of the inner pipes includes an aperture for receipt of a pin for fastening the inner pipe to the grip; wherein each of the inner pipes includes a positioning hole for receipt of a pin for fastening the fixed seat in the inner pipe; and wherein each of the inner pipes includes a retaining hole for receipt of a protuberance formed on the lower seat.

11. the retractable handle of claim 10 wherein each of the first and second outer pipes include a lower portion and an upper portion; and wherein the retractable handle further comprises, in combination: a base seat for receiving the lower portions of the first and second outer pipes; an upper seat fastened to the upper portions of the first and second outer pipes, with the upper seat having first and second holes to receive the first and second inner pipes, respectively.

12. The retractable handle of claim 11 wherein the first and second holes of the upper seat are square.

13. The retractable handle of claim 4 further comprising, in combination: first and second coiled springs disposed between the push button and the grip.

14. The retractable handle of claim 1 wherein the positioning device further comprises, in combination: a positioning aperture on the slide plate; and a compression spring received on the slide plate between the positioning aperture and the fixed seat.

15. The retractable handle of claim 1 wherein the sliding means comprising, in combination: a first rod inserted in the first inner pipe and connected to the slide plate of the positioning device disposed in the first inner pipe; a second rod inserted in the second inner pipe and connected to the slide plate of the positioning device disposed in the second inner pipe; and a push button disposed beneath the grip, with the first and second rods being connected to the push button.

16. the retractable handle of claim 1 wherein the grip comprises, in combination: a first half grip; and a second half grip coupled with the first half grip.

17. The retractable handle of claim 1 wherein each of the first and second inner piped include a notch extending from the lower portion for receipt of the tenon; and wherein each of the first and second inner pipes have a lower seat on the lower portion and for enclosing the notch.

18. The retractable handle of claim 1 wherein each of the inner pipes includes an aperture for receipt of the pin for fastening the inner pipe to the grip; wherein each of the inner pipes includes a positioning hole for receipt of a pin for fastening the fixed seat in the inner pipe; and wherein each of the inner pipes includes a retaining hole for receipt of a protuberance formed on the lower seat.

19. The retractable handle of claim 1 wherein each of the first and second outer pipes include a lower portion and an upper portion; and wherein the retractable handle further comprises, in combination: a base seat for receiving the lower portions of the first and second outer pipes; an upper seat fastened to the upper portions of the first and second outer pipes, with the upper seat having first and second holes the receive the first and second inner pipes, respectively.

20. The retractable handle of claim 19 wherein the first and second holes of the upper seat are square.

* * * * *